United States Patent [19]

Wolfe

[11] 4,184,248

[45] Jan. 22, 1980

[54] FISHING KNIFE

[76] Inventor: Henry S. Wolfe, 314 Harbor View La., Harbor Bluff Largo, Fla. 33540

[21] Appl. No.: 929,226

[22] Filed: Jul. 31, 1978

[51] Int. Cl.[2] ..... B25G 1/00

[52] U.S. Cl. ..... 30/340; 30/344

[58] Field of Search ..... 30/340, 344, 343, 342

[56] References Cited

U.S. PATENT DOCUMENTS

| | | | |
|---|---|---|---|
| D. 49,724 | 10/1916 | Curtiss | 30/340 |
| 305,665 | 9/1884 | Castles | 30/340 |
| 377,334 | 1/1888 | Schweizer | 30/343 |
| 379,415 | 3/1888 | Rice | 30/340 |
| 423,351 | 3/1890 | Streeter | 30/340 |
| 598,463 | 2/1898 | Foster | 30/340 |
| 2,063,653 | 12/1936 | Agostineto | 30/340 |
| 2,727,305 | 12/1955 | Meohas | 30/279 R |

FOREIGN PATENT DOCUMENTS

| | | | |
|---|---|---|---|
| 79125 | 1/1950 | Czechoslovakia | 30/344 |
| 1174727 | 11/1958 | France | 30/340 |

*Primary Examiner*—Robert L. Spruill
*Assistant Examiner*—J. T. Zatarga
*Attorney, Agent, or Firm*—Hubbell, Cohen, Stiefel & Gross

[57] ABSTRACT

An improved fishing knife comprises a handle having a substantially planar side surface and a blade, the shank of the blade being coplanar with the planar side of the handle.

6 Claims, 5 Drawing Figures

FISHING KNIFE

BACKGROUND OF THE INVENTION

1. Field of the Invention

This invention pertains to fishing knives.

2. Statement of the Prior Art

Fishing knives are, of course, essential tools in preparing fish for consumption. Cross cuts, fin and backbone removal, rib cuts, head and tail removal and skinning are exemplary of the operations typically carried out with fishing knives. Heretofore, these operations have been carried out with fishing knives of the type wherein the shank of the blade is in line with the longitudinal axis of the handle. While such knives are suitable for some cutting operations, they are not particularly suited for others. For example, when skinning a fish, the fish is typically placed on a flat surface, such as a tabletop, and the blade is run along the tabletop between the skin and the body. Ideally, the side of the blade should be flush against the tabletop as this facilitates uniform removal of the skin. Thus, with prior art fishing knives, the blade is placed on its side against the tabletop and downward pressure is applied on the handle so as to flex the blade into a substantially flat position. Not only does this create wrist strain, but the difficulty of flexing the blade into a truly flat position often results in the blade cutting through the skin, which creates extra work. Similarly, when separating the fillet from the carcass, it is desirable to place the blade flush against the rib cage. A knife constructed in the usual fashion, i.e. with the blade in line with the longitudinal axis of the handle, would have to be angled when making this cut, thus creating the possibility of cutting through the ribs. This is particularly true in the case of larger fish. Another difficulty created by the prior art construction is that the handle often obscures the user's line of vision with the blade, thereby making accurate work more difficult.

In nonanalogous arts it has been known to construct knives, files, deburring means, etc. with the shank of the implement offset from the longitudinal axis of the handle. Such implements are exemplified by U.S. Pat. Nos. 940,308, 1,219,116, 2,577,406, 2,672,685, 2,737,704 and 2,759,263. These implements, however, even if carried over into the fishing knife art, would be ineffective for carrying out the operations intended to be simplified by the fishing knife of the present invention.

As is pointed out hereinafter, in the preferred embodiment of the invention, not only is the shank of the blade in line with one side surface of the handle, but the handle is also angled upward with respect to the blade. One technique for angling the handles of various implements, including knives, has been disclosed by Bennett in U.S. Pat. No. 4,038,719.

SUMMARY OF THE INVENTION

According to the invention, I have developed an improved fishing knife which facilitates various cutting operations necessary to prepare fish for consumption. The improved knife comprises a handle having a substantially planar side surface and a blade secured to the handle such that the shank of the blade is coplanar with the substantially planar side surface of the handle.

Construction of a fishing knife in accordance with the present invention may be accomplished in a variety of ways, many of which will be discussed in detail hereinafter. However, I presently prefer to employ a blade having a tang angled with respect to the shank, as this permits the use of conventional techniques to firmly secure the tang in the handle. However, a knife in accordance with the invention may also be made by using a conventional blade wherein the tang is coplanar with the shank by securing the tang to the handle such that the tang comprises one side of the handle.

Whatever method of construction is employed, the knife of the invention has certain advantages over prior art knives. These advantages flow from the fact that the shank of the blade is coplanar with one substantially planar side surface of the handle. Thus, the handle of the knife may be placed on its side on a tabletop or other substantially flat surface with the shank of the blade also flush with that surface. Having the shank flush with the surface is extremely advantageous for performing many cutting operations, such as skinning. This arrangement also allows the shank of the blade to be placed flush against the rib cage when removing the fillet from the carcass. Another advantage is that the handle will not obstruct the worker's line of vision and thus permits more accurate work.

In the preferred embodiment of the fishing knife according to the present invention, the handle is relatively wide thus insuring that there will be sufficient surface area to apply the downward thumb pressure necessary in many cutting operations. A wide handle also insures a firm grip. Another preferred feature is angling the handle of the knife upwardly with respect to the shank of the blade as this has been found to avoid the necessity of twisting the wrist into unnatural positions during cutting thus reducing wrist strain. Whatever method of construction is employed, it will be apparent that both right and left hand models of the knife may be made.

Further features and advantages of a fishing knife constructed in accordance with the present invention will become more fully apparent from the following detailed description and annexed drawings of the presently preferred embodiments thereof.

DETAILED DESCRIPTION OF THE PREFERRED EMBODIMENTS

Figure 1:
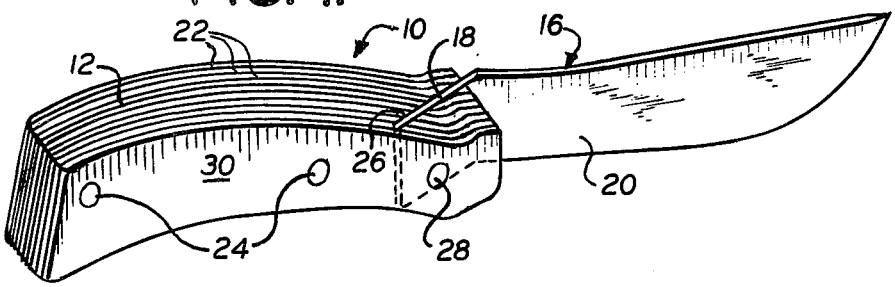
FIG. 1 is a perspective view of the preferred fishing knife constructed in accordance with the present invention.
Figure 2:
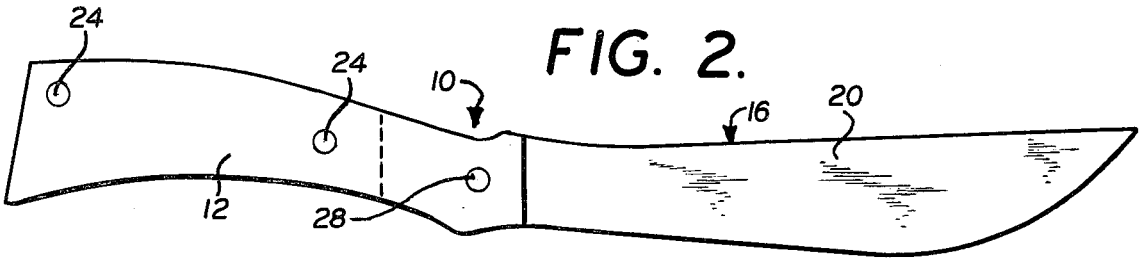
FIG. 2 is a side elevational view of the knife illustrated in FIG. 1.
Figure 3:
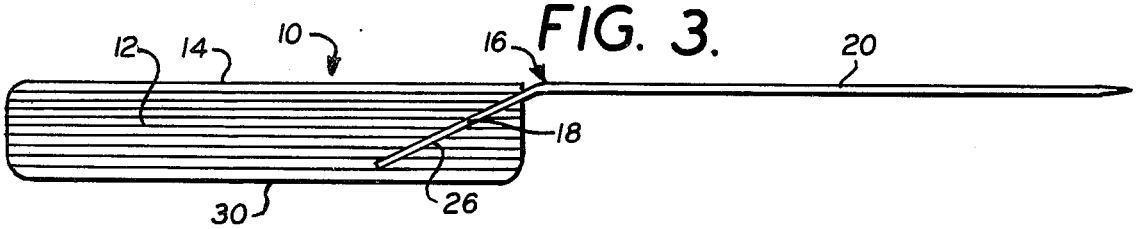
FIG. 3 is a top plan view of the knife shown in FIGS. 1 and 2.

Referring now to the drawings, and initially to FIGS. 1–3 thereof, the presently preferred fishing knife 10 in accordance with the present invention is illustrated. As shown, the knife 10 includes a handle 12 having a planar side surface 14, and a blade 16 comprised of a tang 18 and a shank 20. According to the invention, the blade 16 is secured to the handle 12 such that the shank 20 of the blade is coplanar with the plane defined by the surface 14. As shown, this is preferably accomplished by employing a half tang angled with respect to the shank of the blade, the tang being secured in the handle 12 at an angle to the longitudinal axis thereof. This is preferred since the desired coplanar relation between the shank 20 and the surface 14 is achieved without sacrificing the integrity of the connection between the handle 12 and the blade 16.

The construction of the handle 12 as well as the methods for securing the tang 18 of the blade 16 to the handle may vary. As presently preferred and shown, the handle 12 is formed of wood laminae 22 secured together by a plurality of rivets 24. After the handle 12 is thus formed, a slot 26 for the tang 18 is cut in the forward end of the handle. The tang 18 is then fitted in the slot and, as presently preferred, secured therein by one or more additional rivets 28, although those skilled in the art will recognize that other means, such as a suitable adhesive, may be used for this purpose. As will be apparent hereinafter, it is desirable that the surface defined by the shank 20 and side 14 be completely flat. Therefore, and as illustrated, the rivets 24 and 28 and preferably driven through the handle 12 from the side 30 opposite the side 14 as this avoids the necessity of recessing the heads of the rivets or, alternatively, shaving the rivet heads off, which would be necessary if the rivets were driven in through the surface 14.

While the wood laminated handle 12 is preferred, a one piece wooden handle may also be used following the method of construction described above. Another possibility is to use an injection molded plastic handle. This may be done, for example, by suspending the blade from the shank with the tang disposed in the mold and then injection molding the handle about the tang. To achieve a more secure connection between handle and tang, the tang may be provided with one or more apertures through which the plastic will form. Whatever method of construction is employed, the blade 16 is preferably comprised of hardened stainless steel, although other materials used for making blades, such as carbon steel, may also be used. Preferably, the tang and shank of the blade will be integrally joined, although constructions wherein the tang and shank are joined together as by welding are also possible.

Because the construction of the knife 10 is such that the shank 20 of the blade 16 is coplanar with the side surface 14 of the handle 12, the knife 10 is easier to use and more effective than prior art fishing knives. For example, assuming the knife 10 is provided with a blade 16 suitable for skinning, skinning may be accomplished by placing the side 14 of the handle 12 on a flat surface such as a tabletop. Clearly, the shank 20 of the blade 16 will also be flush with the tabletop. Using the handle 12 to guide the blade, the shank 20 may then be used to trim the skin cleanly away from the body of the fish by sliding the handle along the tabletop. Similarly, when separating the fillet from the carcass, the side 14 and hence the shank 20 may be placed flush against the rib cage. Using the handle 12 to guide the shank 20, the fillet may then be cut cleanly away from the carcass. An additional advantage of having the shank "in line" with one side surface of the handle is that obstruction of the user's line of vision is reduced as compared with prior art fishing knives, thus permitting more accurate work. While this may also be accomplished by offsetting the shank from the longitudinal axis of the handle to a position other than one in which the shank is coplanar with a side of the handle, those skilled in the art will appreciate that if this is done, the user will not be able to place both the shank and the side of the handle flush with the working surface. As is noted above, this is desirable as it enables the user to guide the cutting edge by sliding the handle along the working surface.

Although the particular dimensions of the handle and blade will vary according to particular needs, it is presently preferred that a relatively thick handle 12 be employed. This insures that there is sufficient area to apply the thumb pressure necessary for many cutting operations. A wide handle also insures a firm grip. In addition, and as best shown in FIG. 2, the shank 20 of the blade 16 is preferably angled upwardly from the handle 12. This permits various cuts to be made without twisting the wrist into an unnatural position and thus reduces wrist strain. Although not shown, it is also preferred that the knife be constructed with a flat ground blade, as opposed to one having a prominent grind line, so that the cutting edge will not be angled toward the working surface. When the knife is used for skinning, for example, this further reduces the possibility of cutting through the skin.

Figure 4:
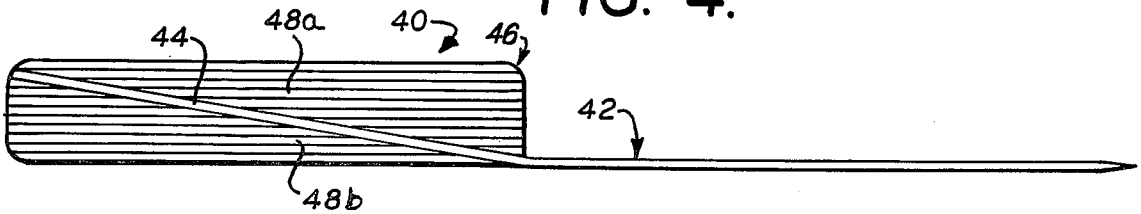
FIG. 4 is a top plan view of an alternative embodiment of a fishing knife in accordance with the present invention.

Referring now to FIG. 4, an alternative embodiment 40 of a fishing knife in accordance with the present invention is illustrated. The knife 40 is in all respects identical to the knife 10 illustrated in FIGS. 1–3 except that the blade 42 has a full tang 44 and the knife 40 is intended for left-handed use. If the knife 40 is constructed with a wooden handle 46, the handle is preferably formed in two separate halves or slabs 48 which may then be fitted about the tang 44 of the blade 42. The tang 44 may then be secured to the slabs 48 as by one or more rivets (not shown) or by other means such as a suitable adhesive. Like the knife 10, the knife 40 may also be formed with a plastic handle as, for example, by following the procedure set forth above.

As noted, the knife 40 is intended for left-handed use. As compared with the knife 10, this requires angling the tang away from the opposite side of the shank and forming the slot for the tang so the shank will be in-line with the opposite side of the handle (compare FIGS. 3 and 4). Those skilled in the art will appreciate that right and left handed versions of all knives constructed in accordance with the invention are both possible and desirable.

Figure 5:
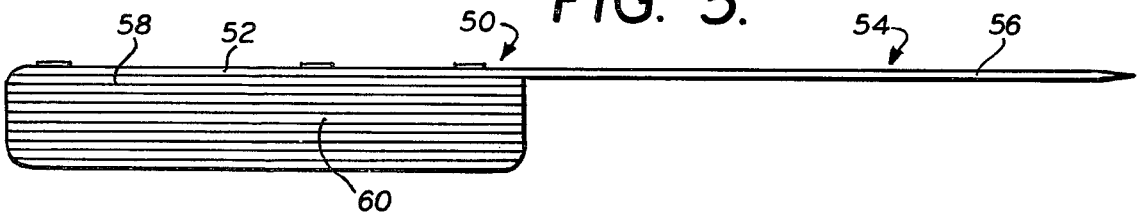
FIG. 5 is a top plan view of a further alternative embodiment of a knife in accordance with the present invention.

Referring now to FIG. 5, a still further embodiment 50 of a fishing knife in accordance with the present invention is shown. Unlike the knives 10 and 40 illustrated in FIGS. 1–4, the tang 52 of the blade 54 is not angled with respect to the shank 56 but, instead, is coplanar therewith. As shown, the tang 52 is secured directly to the side surface 58 of the handle 60 whereby the outwardly facing surface of the tang 52 serves as one side of the handle. Accordingly, the shank 56, being coplanar with the tang 52 is, in accordance with the invention, coplanar with a side surface of the handle.

It will be apparent that if rivets (not shown) are employed to secure the tang 52 to the handle 60, the rivets must be driven through the tang into the handle. If no further steps are taken, the heads of the rivets will protrude above the outwardly facing surface of the tang which, as noted above, is undesirable. Accordingly, the heads of the rivets will preferably be shaved and the stubs smoothed. Alternatively, means other than rivets may be employed to secure the tang to the handle. For example, if the handle is comprised of wood, wood screws inserted through counterbore holes in the tang may be used.

Although blade 54 of the knife 50 is shown as having a full tang 52, this is not necessary. However, if substantially less than a full tang is used, the side surface 58 of the handle should be recessed for accommodating the tang, the depth of the recess being equal to the thickness of the tang. Thus, when the tang is fitted in the recess and secured to the handle, the shank, the tang and the unrecessed portion of the side 58 will define a flat surface.

As a further alternative, a knife in accordance with the present invention may be integrally constructed as, for example, from stainless steel. As is the case with each knife constructed in accordance with the invention, the only requirement is that the cutting portion or shank of the blade be coplanar with one side surface of the handle. Although such a knife will be more expensive to construct than the embodiments discussed above, the integral construction avoids the necessity of securing the tang to the handle.

In those embodiments where the tang is angled with respect to the blade, the actual angle will depend on the particular dimensions of the knife, the selection of a proper angle being well within the capabilities of the skilled art worker. It is also shown and preferred that the tang intersects the shank substantially at the front of the handle. However, this is not necessary. Thus, embodiments wherein the point of intersection is in front of or behind the front of the handle are possible, provided the condition is met that the shank is coplanar with a side of the handle. Therefore, if the point of intersection is behind the front of the handle, in which case the rear of the shank will rest on the side of the handle, that side should be recessed to accommodate the rear of the shank for the reasons set forth above in connection with the embodiment of FIG. 5.

As used herein, the term "full tang" means a tang which extends substantially the full length of the handle. A "half tang" means a tang which extends less than substantially the full length of the handle and is not limited to a tang extending half the length of the handle.

While I have herein shown the preferred embodiments of the present invention, and have suggested changes and modifications thereto, those skilled in the art will appreciate that still further changes and modifications may be made within the scope of the present invention. Accordingly, the above description should be construed as illustrative and not in the limiting sense, the scope of the invention being defined by the following claims.

What is claimed is:

1. A fishing knife comprising:

a blade including a shank and a connected tang in angular relationship with said shank; and a handle having a substantially planar surface, said handle having a slot therein extending in the same angular relationship with the plane of said planar surface as that of said tang with said shank such that said tang is secured to said handle in said slot with said shank substantially coplanar with said planar surface.

2. The knife according to claim 1, wherein said handle has a front end, and the point of intersection of said tang with said shank is substantially at the front end of said handle.

3. The knife according to claim 2, wherein said tang is a full tang.

4. The knife according to claim 1, wherein said handle angles upwardly relative to said shank.

5. The knife according to claim 2, wherein said tang is a half tang.

6. The knife according to claim 2, wherein said tang is integrally connected to said shank.

* * * * *